US011974618B2

(12) United States Patent
Blythe et al.

(10) Patent No.: US 11,974,618 B2
(45) Date of Patent: May 7, 2024

(54) POCKET BAND

(71) Applicant: DRYMAX TECHNOLOGIES, INC., Paso Robles, CA (US)

(72) Inventors: William A. Blythe, Paso Robles, CA (US); Charles R. Coffey, Fyffe, AL (US)

(73) Assignee: DRYMAX TECHNOLOGIES, INC., Paso Robles, CA (US)

( * ) Notice: Subject to any disclaimer, the term of this patent is extended or adjusted under 35 U.S.C. 154(b) by 81 days.

(21) Appl. No.: 17/522,392

(22) Filed: Nov. 9, 2021

(65) Prior Publication Data

US 2022/0142308 A1 May 12, 2022

Related U.S. Application Data

(60) Provisional application No. 63/111,571, filed on Nov. 9, 2020.

(51) Int. Cl.
*A41D 20/00* (2006.01)

(52) U.S. Cl.
CPC ..... *A41D 20/00* (2013.01)

(58) Field of Classification Search
CPC ..... A41D 20/00; A41D 27/20; A41D 27/205; A41D 1/002; A41D 27/204; A41D 27/207; A41D 19/002; A41D 13/0012; A41D 13/088; A45C 1/04; A45F 2003/006; A45F 2005/008; A41B 11/006; A44C 5/003
USPC ..... 2/170, DIG. 11
See application file for complete search history.

(56) References Cited

U.S. PATENT DOCUMENTS

| | | | | |
|---|---|---|---|---|
| 243,252 A | | 6/1881 | Harbison | |
| 413,749 A | | 10/1889 | Carrier | |
| 668,800 A | | 2/1901 | Knapp | |
| 872,137 A | | 11/1907 | Lauperty | |
| 1,117,591 A | * | 11/1914 | Morningstar | A41B 11/006 D2/983 |
| 1,206,171 A | * | 11/1916 | Thierfelder | A41B 11/12 66/172 R |
| 1,981,057 A | | 11/1934 | Lombardi | |
| D99,164 S | | 3/1936 | Levine | |

(Continued)

FOREIGN PATENT DOCUMENTS

| | | | |
|---|---|---|---|
| AU | 2007246238 | A1 | 11/2007 |
| AU | 2008200440 | A1 | 3/2010 |

(Continued)

OTHER PUBLICATIONS

English language translation of DE 20210863 (Avazpour) Doc pub. Feb. 2003 (Year: 2003).*

(Continued)

*Primary Examiner* — Amy Vanatta
(74) *Attorney, Agent, or Firm* — Christopher J. Knors; Moore & Van Allen PLLC

(57) ABSTRACT

The present disclosure relates to an article of clothing that provides storage, more specifically, a continuous tubular welt comprising a first open end and a second open end; an outer surface between the first open end and the second open end, the outer surface continuously separated from an inner surface so as to define a continuous interior volume and at least one pocket providing access to the interior volume.

8 Claims, 6 Drawing Sheets

(56) References Cited

U.S. PATENT DOCUMENTS 2,039,197 A * 4/1936 Strieby ..... A41B 11/006 D2/980
D160,416 S 10/1950 Mueller
D163,988 S 7/1951 Breath
2,591,905 A 4/1952 Kennedy
2,643,389 A 6/1953 Wegner
4,005,494 A * 2/1977 Burn ..... D04B 1/26 2/239
4,014,046 A 3/1977 Craig
4,038,699 A * 8/1977 Burn ..... A41B 11/006 66/189
4,047,400 A 9/1977 Thorneburg
4,068,318 A * 1/1978 McMahon ..... A41D 20/00 222/215
D257,884 S 1/1981 Ternstrom
4,399,567 A 8/1983 Weon Joong
4,462,116 A * 7/1984 Sanzone ..... A41D 20/00 2/253
4,499,741 A 2/1985 Harris
4,521,922 A 6/1985 Mitchell et al.
4,843,653 A 7/1989 Coble
D308,436 S 6/1990 Weitzell
4,947,488 A 8/1990 Ashinoff
5,117,510 A * 6/1992 Broussard ..... F21L 4/005 2/209.13
5,119,513 A 6/1992 McKay
5,133,091 A * 7/1992 del Valle Mas ..... A41B 11/006 2/247
5,297,296 A 3/1994 Moretz et al.
5,511,241 A 4/1996 Ziegler
D370,111 S 5/1996 Walker
D372,878 S 8/1996 Finnegan
5,651,142 A * 7/1997 del Valle Mas ..... A41B 11/006 2/247
5,664,263 A * 9/1997 Reynolds ..... A41B 11/006 2/247
5,671,481 A * 9/1997 Giard ..... A41D 20/00 224/222
5,746,067 A 5/1998 Leach, II
5,823,012 A 10/1998 Hackaylo
D402,411 S 12/1998 Radler
6,065,311 A * 5/2000 Essig ..... D04B 1/22 66/64
6,113,565 A 9/2000 Schlup
D433,197 S 10/2000 Niksich
6,332,225 B1 12/2001 Casey
6,349,414 B1 2/2002 Tillman
D453,985 S 3/2002 Casey
6,383,157 B1 5/2002 Massi et al.
6,425,137 B1 7/2002 Fakhrai
6,460,380 B1 * 10/2002 Sciacca ..... D04B 1/246 66/21
6,701,532 B1 3/2004 Glassberg et al.
D491,829 S 6/2004 Seifert
6,974,366 B1 12/2005 Johnson
D517,442 S 3/2006 Polk, III
D550,112 S 9/2007 Andren et al.
D553,536 S 10/2007 Andren
D556,194 S 11/2007 Rambosek et al.
D558,198 S 12/2007 Blankenship et al.
D565,828 S 4/2008 Page
D569,577 S 5/2008 Barker
D584,972 S 1/2009 Aeberhard et al.
D604,191 S 11/2009 Ohara
D651,535 S 1/2012 Rodarmel
8,099,794 B2 * 1/2012 Carstens ..... G06F 1/163 2/311
D681,941 S 5/2013 Kennedy et al.
D685,284 S 7/2013 Spano
D705,112 S 5/2014 Namazy
D727,613 S 4/2015 Schoenbeck
D731,345 S 6/2015 Stewart
D738,748 S 9/2015 Bibl
D739,274 S 9/2015 Chen
D743,131 S 11/2015 Jeon
D744,890 S 12/2015 Murphy
D750,902 S 3/2016 Duparc
D753,357 S 4/2016 Song
D781,048 S * 3/2017 Couture ..... A45F 3/005 D2/980
D791,430 S 7/2017 Sheedy
D858,937 S 9/2019 Sweeting
D919,229 S 5/2021 Bryngelson
D973,304 S 12/2022 Lassila
2002/0122890 A1 9/2002 Linford et al.
2003/0221241 A1 5/2003 Rivera
2003/0176904 A1 9/2003 Patterson
2006/0261108 A1 * 11/2006 Watts ..... A45C 1/04 224/222
2007/0194066 A1 * 8/2007 Ishihara ..... A41D 1/002 224/164
2008/0000009 A1 1/2008 Kogawa
2009/0007597 A1 1/2009 Hanevold
2009/0151045 A1 6/2009 Hinds et al.
2009/0205106 A1 8/2009 Sohn
2009/0206117 A1 8/2009 Chan
2009/0307825 A1 12/2009 Bhalla
2011/0250979 A1 10/2011 Dean
2011/0296588 A1 * 12/2011 Cummings ..... A41B 11/006 2/239
2012/0129418 A1 * 5/2012 Ingle ..... D06M 11/83 2/463
2013/0048695 A1 * 2/2013 Do ..... A41D 27/205 224/676
2014/0123702 A1 5/2014 Pierce
2014/0245520 A1 9/2014 Bae
2014/0365979 A1 12/2014 Yoon
2015/0049591 A1 2/2015 Adams
2015/0143600 A1 5/2015 Donald
2015/0309535 A1 10/2015 Connor
2016/0143424 A1 * 5/2016 Stephens ..... A45F 3/005 224/676
2016/0262470 A1 9/2016 Blythe
2018/0084852 A1 * 3/2018 Page ..... A41D 19/002
2018/0110274 A1 * 4/2018 LaRue ..... A41D 31/285
2020/0029636 A1 1/2020 Kelly

FOREIGN PATENT DOCUMENTS

DE 20210863 U1 * 2/2003 ..... A45F 5/00
DE 202010004746 U1 * 9/2010 ..... A45F 3/00
DE 202010010851 U1 * 11/2010 ..... A41D 13/08
WO 9833562 A1 8/1998
WO 2007129853 A1 11/2007

OTHER PUBLICATIONS

"Terry cloth sweat wristbands," 2016, <http://terrywristband.com/sweatband/index.php?main_page=product_reviews_info&products_id=275&reviews_id=18&zenid=50523ade7ca25af7aff1b3a9bacff213>.
"NIKE Adult Fielder's Wrist Guard" Oct. 8, 2013, Baseball Savings <http://reviews.baseballsavings.com/9058/41799/nike-adult-fielders-wrist-guard-reviews/reviews.htm>.
"Nike Dri-fit Stealth Wristbands" Apr. 8, 2016, Sports Unlimited <http://www.sportsunlimitedinc.com/nike-dri-fit-stealth-wristbands.html>.
"Wrist Sweatband" Apr. 8, 2016, Sadiq Sports <http://www.sadiqsports.com/detail.php?nod=2125>.
Terry cloth sweat wristbands Mar. 16, 2009. Terrywristband.com https://terrywristband.com/sweatband/index.php?main_page=product_info&cPath=23_50&products_id=211&zenid=bb46da98cd315511286095866f91fd56.
"Black Number embroidery sweat wristband—No. 8 (eight) embroidered in dark orange thread" Jan. 9, 2015. Couver. https://x.couver.US/index.php?main_page=product_info&products_id=1959.
"Black 4' Wrist Sweatband Customizable Number for All Sports." Posted Apr. 21, 2008. Couver. https://x.couver.us/index.php?main_page=product_info&cPath=69_81_179&products_id=830.
Mkeegan, "How to Knit: Swiss Darning," Woman's Weekly, Aug. 28, 2013, www.womansweekly.com/kintting/how-to-guide-swiss-darning-12822/ (Year: 2013).

(56) References Cited

OTHER PUBLICATIONS

Arm Sweatbands. before Feb. 24, 2014. Suddora. http://www.suddora.com/products/multiple-color-plain-arm-sweatbands?gclid=EAlalQobChMlgP3JvJus3AIVDuDICh12qgiGEAQYBSABEgKkkPD_BWE.
"Reebok Wrist Guard 3 Inch." 2013. Pure Hockey. https://www.purehockey.com/product/Wrist_Guard_3_inch/itm/14535-2/.
"Evo Shield Wrist Guard." May 29, 2011. Youtube. https://www.youtube.com/watch?v=KcoFkmr9mvo.
"All-Star Padded Foam Padded Sports Wristbands." Before Jun. 1, 2011. Epic Sports Soccer. http://soccer.epicsports.com/prod/14845/all-star-foam-padded-sports-wristband-pairs.html#reviews.
"COUVEAR Athletic Sweat Wristbands." Before Feb. 21, 2008. Couver. http://x.couver.us/index.php?main_page=product_info&products_id=272.
Nike Swoosh Wristbands. Before May 21, 2013. EastBay. http://www.eastbay.com/product/model:196273/sku:404101/nike-swoosh-wristbands/white/black/.
Tofern Sports Gel Wrist Band. Mar. 5, 2015. Amazon. https://www.amazon.co.uk/Tofern-Superior-Basketball-Wristband-Sweatband/dp/B00UAF06EK.
"Evoshield Molded Wrist Guard." Before Feb. 22, 2012. EastBay. http://www.eastbay.com/product/model:181420/sku:20451505/evoshield-molded-wrist-guard-mens/gold/black.
Sports Wristband Wallet, posted Jul. 11, 2019 [online], (retrieved Apr. 3, 2023). Retrieved from the internet, https://www.amazon.com/ Wristband-Workout-Breathable-Sweatband-Running/dp/B07V8RPG3L (Year: 2019).
Locker Lifestyle Premium Wrist Locker, posted Sep. 6, 2022 [online], (retrieved Apr. 3, 2023). Retrieved from the internet, https://www.amazon.com/dp/BOBDB334CD/ref=sspa_dk_detail_2?pd_rd_i = BOBDB334CD&pd_rd_w=EXOJJ&content-id=amzn1.sym.eb7c1ac5-7c51%E2%80%A6 (Year: 2022).

* cited by examiner

POCKET BAND

CROSS-REFERENCE TO RELATED APPLICATIONS

This application claims the benefit of U.S. Provisional Application No. 63/111,571 filed on Nov. 9, 2020, the entirety of which is incorporated herein by reference.

TECHNICAL FIELD

The present disclosure relates to an article of clothing that provides storage, more specifically, a continuous tubular welt comprising a first open end and a second open end; an outer surface between the first open end and the second open end, the outer surface continuously separated from an inner surface so as to define a continuous interior volume and at least one pocket providing access to the interior volume.

BACKGROUND

Most known bands, such as "sweatbands," "leg bands," "headband," "wristbands" or "armbands" are typically worn around the associated body part and provide a variety of useful functions. Such conventional bands are generally made of a terry-knit cloth with an elastic or stretch material woven or otherwise encased therein, or by other means. However, such articles of clothing are devoid of useful storage compartments or pockets, in particular, storage compartments or pockets that are arranged on the inner surface of the article of clothing. Moreover, such articles of clothing are not generally employed for reversibly receiving tracking devices, and/or providing contact tracing in the event of epidemics or pandemics.

Certain events can create a situation where it is desirable to have proximity histories (e.g., contact tracing capabilities) determined for individuals who are otherwise in close proximity to other individuals, for example, during sporting events, concerts, workplaces, schools, and other social gatherings. Several positioning systems to determine the position of an object/subject are known in the art. The most famous positioning system is the Global Positioning System (GPS), which provides geolocation and time information to a GPS receiver anywhere on Earth where there is an unobstructed line of sight to four or more GPS satellites.

SUMMARY

In one example, an article of fabric is provided, the article of fabric comprising: a continuous tubular welt comprising a first open end and a second open end; an outer surface between the first open end and the second open end, the outer surface continuously separated from an inner surface so as to define a continuous interior volume; and at least one pocket integral with the inner surface, the at least one pocket having an opening at least partially circumscribing the inner surface and providing access to the continuous interior volume.

In one aspect, the opening is more proximal to the first open end or the second open end.

In another aspect, alone or in combination with any of the previous aspects, the at least one pocket comprises a heel. In another aspect, alone or in combination with any of the previous aspects, the at least one pocket is integrally knitted into the interior volume.

In another aspect, alone or in combination with any of the previous aspects, the article further comprises a metal-containing yarn. In another aspect, alone or in combination with any of the previous aspects, the fabric comprises hydrophobic yarns in proximity to the inner surface and an amount of hydrophilic yarns more distant from the inner surface.

In another example, an article of fabric is provided, the article of fabric comprising a generally tubular shape body having an inner surface with a generally symmetric inner circumference, an outer surface having a generally non-symmetric outer circumference, and a pocket located in the inner surface, the pocket having an opening at least partially circumscribing the inner skin facing surface. In one aspect, the non-symmetrical outer circumference extends along a longitudinal axis of the article.

In another aspect, alone or in combination with any of the previous aspects, the article further comprises a contact tracing system component.

BRIEF DESCRIPTION OF THE DRAWINGS

The following detailed description and accompanying drawings provide a more detailed understanding of the nature and advantages of the present disclosure.

DETAILED DESCRIPTION

Figure 1:
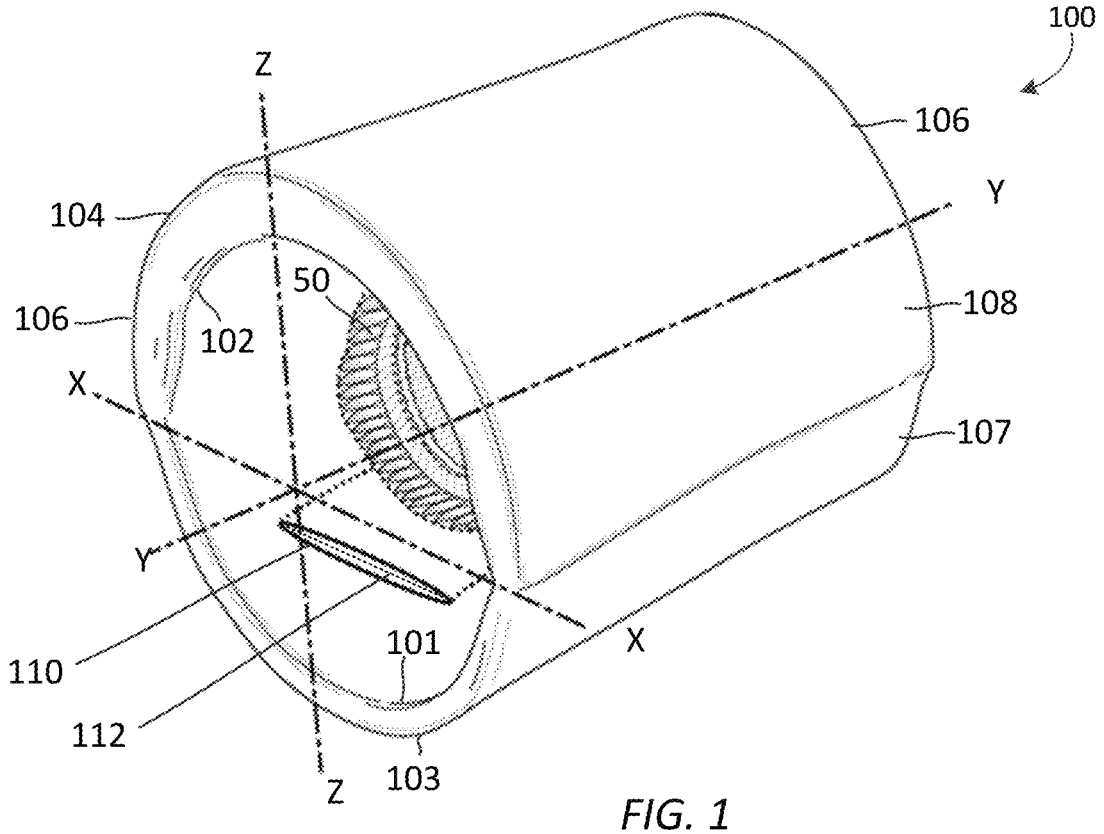
FIG. 1 is a perspective view of an article as described and disclosed herein, shown relative to a X-Y-Z coordinate axis.

Articles of clothing with storage compartments are known, however, many sport clothing items forgo conventional "pockets" for aesthetics. There is a need in the art to provide for clothing items that contain storage, for example keys, key fobs, credit cards, folded money and/or coins, jewelry, and small electronic devices. Such articles of clothing should be aesthetically pleasing, non-obtrusive when used for storage, and not detract from the functionality of the clothing item.

In addition, devices suitable for accurate proximity history and/or contact tracing are known and are of a size such that is non-obtrusive and/or does not interfere with the athletic activity, however, equipment is generally not adapted for receiving such devices. Therefore, there is a need in the art to provide for reversibly receiving devices suitable for accurate proximity history and/or contact tracing during a sporting event with an article of clothing which is comfortable, unobtrusive, and aesthetically and functionally accepted by athletes.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular examples only and is not intended to be limiting of the present disclosure. As used herein, the singular forms "a", "an" and "the" are intended to include the plural forms as well, unless the context clearly indicates otherwise. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

As used herein, the term "fabric" refers to any material made through weaving, knitting, spreading, crocheting, or bonding. In one aspect, fabric is inclusive of any material made through knitting or crocheting that may be used in production of an article i.e., a garment.

As used herein, the terms "welt" and "knit" as well as their grammatical equivalents are used herein interchangeably.

As used herein, the phrase "pocket band" is inclusive of a wrist band, arm band (upper and/or lower arm), head band, neck band, leg band (thigh and/or calf), or ankle band.

As used herein, the term "tubular" is inclusive of a tubular knitted or woven structures of fabrics. In certain aspects, the term "tubular" is inclusive of a tubular structure having a wall thickness that is essentially the same along the length of the tubular structure, or of a tubular structure having a wall thickness that is non-symmetrically different along the length of the tubular structure. In certain aspects, the term "tubular" is inclusive of a tubular structure without a seam extending along its longitudinal length, either inside or outside.

As used herein, the term "layer" is used to describe at least two courses of knitted yarn and includes yarns or yarns interwoven with a layer adjacent thereto. In general, layers of different yarns or yarns are readily discernible in magnified cross-sectional views and/or using dyes. Yarns can include metal-containing yarns, for example, yarns containing copper, silver, or zinc.

As the subject matter generally refers to fabrics, slight variation in wall thickness due to the nature of knitted welts is to be expected, but generally, a wall thickness variation of less than 10%, would be considered "symmetrical." Whereas, the term "non-symmetrical" as used herein relates to an inner and outer wall thickness change of greater than about 1.5 times, preferably about 1.5 to about 5 times or more, and more specifically, defined sections of longitudinal length having such difference in inner and outer wall thicknesses.

In one example, a unique approach to an athletic "pocket band," providing a readily apparent and observable decreased thickness (a thick and a thin section) is provided. The article includes plain-knit, relatively snug welt areas and a Terry loop or pile knit which also provides a surface for the knitting in, printing, or other application of an ornamental decorative area or other indicia. In one example, a Terry loop of hydrophobic yarn is provided on the inside (skin facing) surface to give the pocket band some thickness and/or bulk and a hydrophilic yarn is provided on the outside surface. In another example, hydrophobic yarn (creating a layer) is configured next to the skin-facing surface as Terry loops and also on the outside surface as a flat knit, creating a sandwich Terry knit.

In one example, the indicia is configured for modification by the end-user to provide at least one Arabic number and/or letter as disclosed in co-assigned US Patent Publication Application No. 2016/0262470, the contents of which are incorporated herein by reference. The article of the present disclosure can be a welt prepared as a combination of plain knit or single knit with distinct right and wrong sides, with fine ribs running lengthwise on the article's face, and semicircular-like loops running across the reverse face or "skin-facing" side, and Terry loop or pile knit. Other knitting styles and techniques can be used.

In one example, the article comprises a continuous tubular welt comprising a first open end and a second open end; an outer surface between the first open end and the second open end, the outer surface continuously separated from an inner surface so as to define a continuous interior volume; and at least one pocket integral with the inner surface, the at least one pocket having an opening at least partially circumscribing the inner surface and providing access to the continuous interior volume.

In another example, the article comprises a tubular construction that is of a stretchable, crosswise plain-knit welt symmetrical with a crosswise Terry loop or pile knit construction. In one example, the article is of approximately three to seven (3-7) inches in diameter and about 1 to 24 inches in length. In one example, the article is configured having a first portion of a first thickness about the circumference and/or the length, and a second portion of a second thickness is different from that of the first thickness about the circumference and/or the length. In such a configuration, the article can be worn with a thinner portion predominately on one side of the wrist, arm, ankle, leg and a thicker portion on the opposite side thereof.

In one example, when the pocket band is a wristband configured as having a first portion of a first thickness about the circumference and/or the length, and a second portion of a second thickness is different from that of the first thickness about the circumference and/or the length, the thinner portion is worn on the inner side of the wrist e.g., adjacent the palm side of the hand, where the pocket at least partially circumscribes the thinner portion of the pocket band. In addition, the thinner inside of the wrist of the presently disclosed article is more comfortable to an athlete wearing a glove, mitt, or a brace, as it may reduce pressure against the glove, mitt or brace as well as the wrist area. In one example, In another example, where the pocket band is configured as having a first portion of a first thickness about the circumference and/or the length, and a second portion of a second thickness is different from that of the first thickness about the circumference and/or the length, the pocket at least partially circumscribes the thicker portion of the pocket band.

In one example, the article of fabric comprises a tubular welt, a first open end, a second open end; an outer surface having an outer circumference; an inner skin-facing surface having an inner circumference, the inner surface separated from the outer surface by a thickness of fabric, a first portion of a first thickness, a second portion of a second thickness, the first thickness different from that of the second thickness along a substantially continuous length of the tubular welt and a pocket located in the thickness of fabric, the pocket having an opening allowing access thereto. In one example, the pocket has a heel.

In another example, a method of making non-symmetrical tubular article of fabric is provided, the method comprising the steps of: knitting, in a circular knitting machine, a tubular welt having a first section of a first thickness; transitioning to a second section having a second thickness less than the first thickness; and joining opposing ends of the tubular welt. In one aspect, the method comprises the steps of (a) knitting a makeup of elastic yarn; (b) beginning a heel function to provide the heel and pocket walls; (c) ending the heel function so as to provide the opening of the pocket; (d) knitting a plain or flat knit comprising hydrophobic yarns; (e) knitting a Terry Loop or Pile welt comprising hydrophobic yarns; (f) transitioning the knitting of step (g) to hydrophilic yarns; (h) transitioning the knitting of step (f) to hydrophobic yarns; and (i) repeating step (d). In another aspect, the method comprises the steps of (a) knitting a makeup of elastic yarn; (b) beginning a heel function to provide the heel and pocket walls; (c) ending the heel function so as to provide the opening of the pocket; (d) knitting a plain or flat knit comprising hydrophobic yarns; (e) knitting a Terry Loop or Pile welt comprising hydrophobic yarns; (d) optionally transitioning the knitting of step (e) to hydrophobic yarns; and (f) repeating step (d). In some embodiments, the method further includes the step of knitting a color contrasting design in the knit, for example, about the opening of the pocket. In one example, the method further comprises removing the heel of the pocket so as to provide access to the complete interior volume of the article via the opening.

Referring now to the Figures, article 100 generally comprises a continuous welt about a first end and a second end (collectively "106") having a first portion 108 and a second portion 107 along the longitudinal length (as shown by Y axis). As shown in FIG. 1, first portion 108 extends longitudinally and symmetrically from second portion 107 about the X axis. First portion 108 of article 100 comprises a wall thickness defined by (skin-facing) inner surface 102 and outer surface 104 which is thicker than second portion 107 of the article 100, which has a wall thickness as defined by skin-facing inner surface 101 and outer surface 103. In one example, the circumference of the (skin facing) inner surface is generally symmetric, whereas the circumference of the outer surface is generally non-symmetric or has non-symmetry. In some embodiments, first portion 108 has a wall thickness that is 1.5 times greater than a wall thickness of the second portion. In other embodiments, first portion 108 has a wall thickness that is that least 2 times greater than a wall thickness of the second portion. In some embodiments, first portion 108 has a wall thickness that is at least 3 times greater than a wall thickness of the second portion. First portion 108 can be more than 3 times greater in wall thickness than the second portion, however, in one example, first portion 108 may be no more than 5 times greater in wall thickness than the second portion. In another example, the circumference of the (skin facing) inner surface and the circumference of the outer surface is generally symmetric.

Figure 2A:
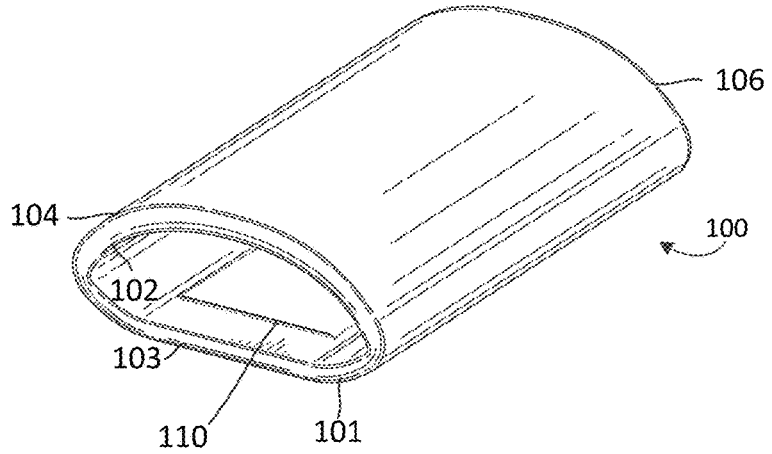
FIG. 2A is a perspective view of the article of FIG. 1, exemplary configured as a wristband.
Figure 2B:
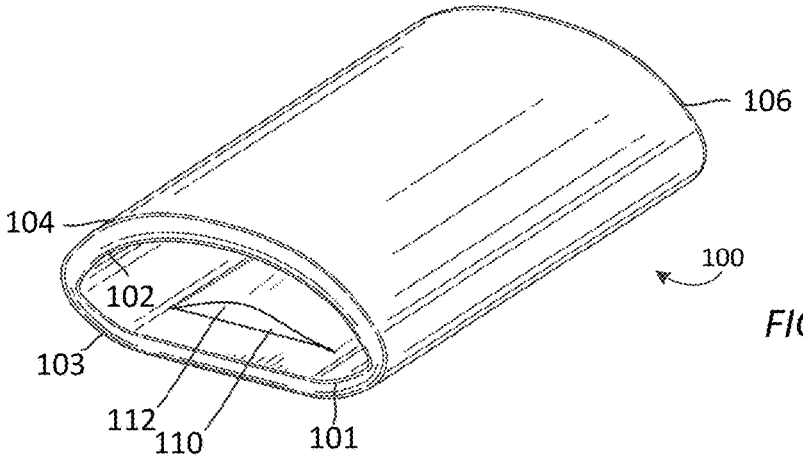
FIG. 2B is a perspective view of the article of FIG. 2A, depicting a storage compartment as disclosed and described herein.
Figure 2C:
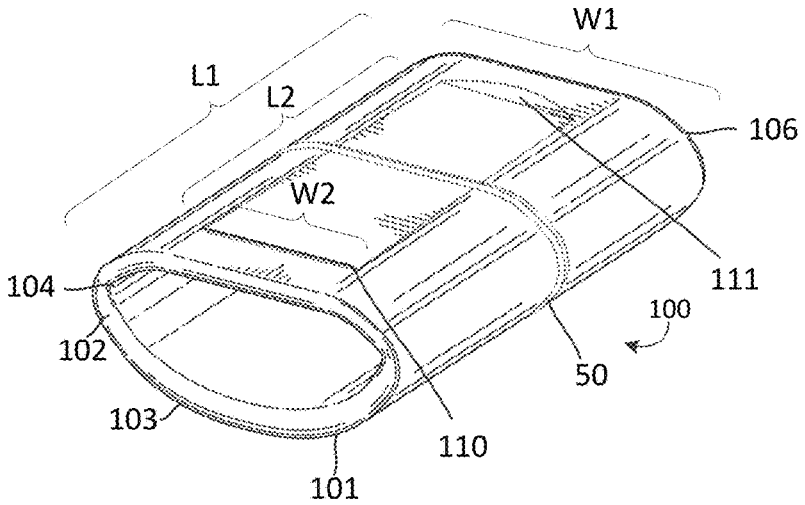
FIG. 2C is a perspective view of the article of FIG. 1, depicted as turned inside out to more fully depict the storage compartment as disclosed and described herein.

As shown in FIGS. 2A, 2B and 2C, the generally continuous tubular shape body has a first open end and a second open end, an inner (skin-facing) surface having an inner circumference the inner circumference physically separated from an outer surface providing an interior volume 109 between the inner surface and the outer surface, wherein the inner surface has a circumference that is generally symmetric, and the outer surface circumference is generally non-symmetric with a remainder portion of the second thickness being less than that of the first thickness. Storage compartment or pocket 110 is shown in proximity to an end of the article 100. Storage compartment or pocket 110 has an opening 112 defined as W2 that is less than width W1 of the tubular welt, a length defined as L2 that is less than length L1 of the tubular welt. Storage compartment 110 terminates at heel 111 adjacent to opposite end of tubular welt. Article 100 is essentially seamless along its longitudinal length, having a welt 50 on the inner skin-facing surface. Compartment or pocket 110 is integrally knitted with the tubular welt.

The tubular article 100 can be knit on a circular knitting machine of the type which permits selected courses to be plain knit and selected courses to be Terry loop or pile knit, to the completion of a seamless tubular article of desired circumference and length. In one example, the tubular article is manufactured in a circular knitting machine that creates a tubular welt which is shed from the needles in a completed welt state and where a storage compartment or pocket 110 is created at least in a portion of the tubular welt with either a thick or a thin section. Thus, in one example, the storage compartment or pocket 110 is present in the thick section, whereas, in another example, the storage compartment or pocket is present in the thin section. In another example, the article 100 has a symmetrical thickness and the storage compartment or pocket is integrally knitted within the thickness.

Figure 3:
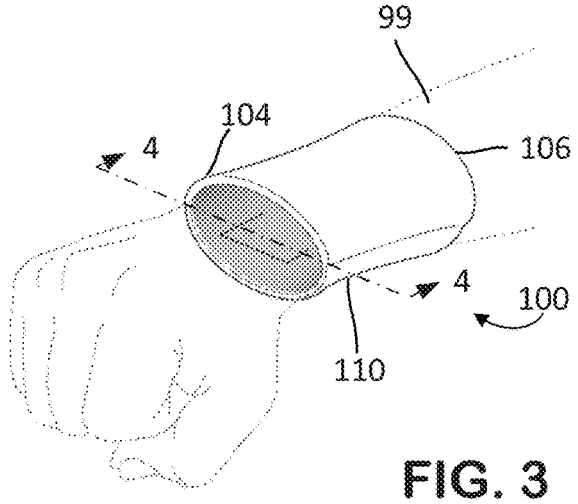
FIG. 3 depicts a perspective view of the article, exemplary shown as a wristband, in use as disclosed and described herein.
Figure 4:
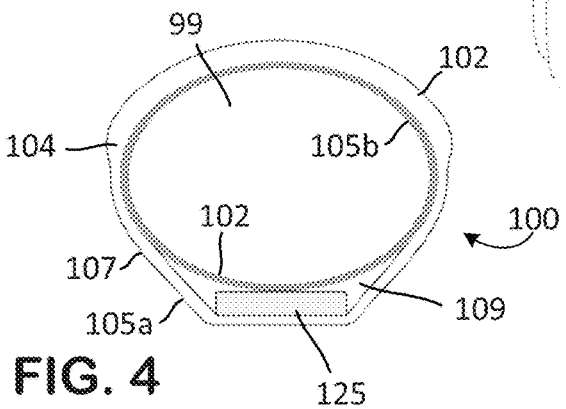
FIG. 4 is a section view of the article of FIG. 3 shown along section line 4-4.

With reference to FIG. 3 and FIG. 4, article 100 is shown in use represented by way of example as a wristband, whereas storage compartment or pocket 110 is shown in receipt of object 125. Article 100 is essentially outer tube 105*a* that becomes inner tube 105*b* at ends 106 of knitted fabric. Storage compartment or pocket 110 is created with a heel and sidewalls (discussed in more detail below) that is positioned between the two tubes 105*a*, 105*b* for reversibly receiving one or more object 125. Object 125 can be keys, key fobs, credit cards, folded money and/or coins, jewelry, and small electronic devices. In one example, the pocket band is configured to reversibly receive a dispenser capable of providing a liquid, gel, or paste, for example a moisturizer, medicament, hand sanitizer, perfume, or the like. In one example, the dispenser is refillable. In one example, object 125 is a location/tracking device.

Figure 5A:
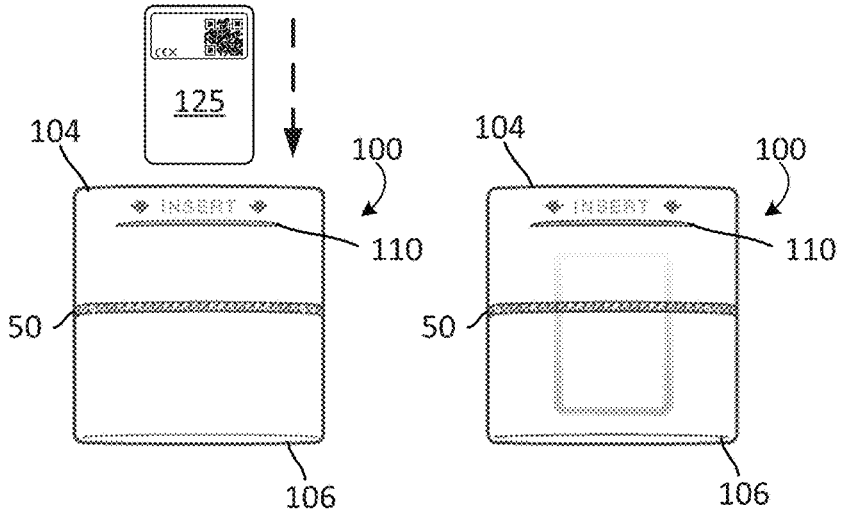
FIG. 5A depicts the article, shown in an inside-out configuration, reversibly receiving an object in the storage compartment.
Figure 5B:
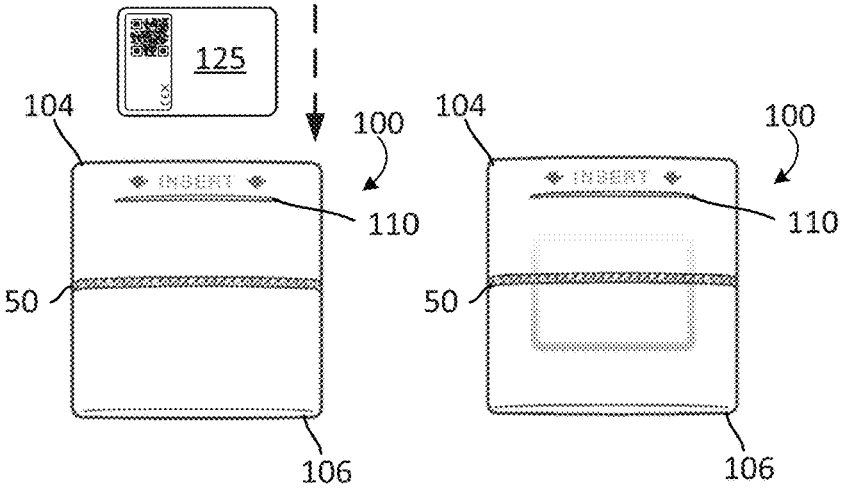
FIG. 5B depicts the article, shown in an inside-out configuration, reversibly receiving an object in the storage compartment.

With reference to FIGS. 5A and 5B, object 125, for example a location/tracking device is shown being inserted into storage compartment or pocket 110 of article 100

(where article 100 is depicted in an inside-out configuration). As shown, object 125 can be inserted into storage compartment or pocket 110 lengthwise or widthwise as the size of opening 112 of storage compartment or pocket is adjustable by virtue of the elasticity of the yarns used to create article 100. After receiving object 125, storage compartment or pocket 110 essentially closes opening 112 and secures object.

Figure 6:
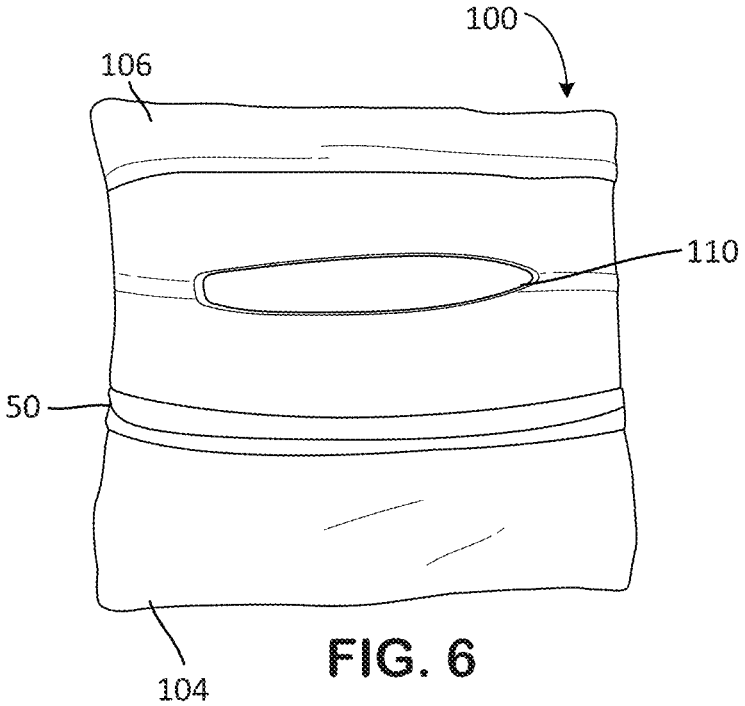
FIG. 6 is a digital image of the article in an inside-out configuration showing the storage compartment.
Figure 7:
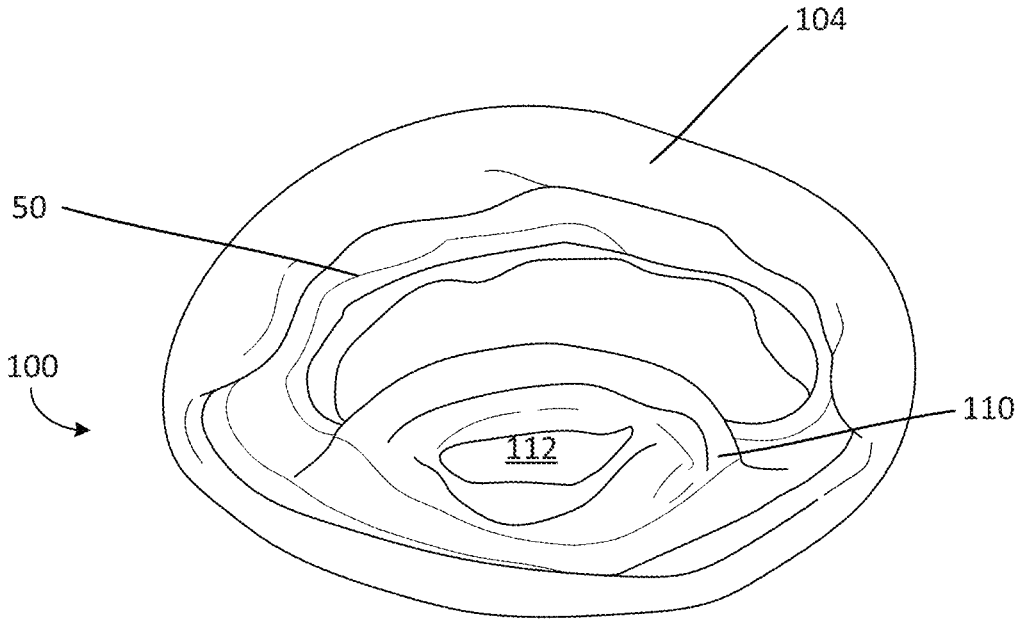
FIG. 7 is a digital image plan view of the article showing the storage compartment in an open configuration.

With reference to FIG. 6 and FIG. 7, digital images of the inside skin-facing surface (inside-out and view thru article's open end) are shown. As shown in FIG. 6, opening 112 of storage compartment or pocket 110 can be provided with color contrasting. As shown in FIG. 7, storage compartment or pocket 110 is shown in an open configuration for reversibly receiving an object. As the article 100 of FIG. 7 is not shown in use, there is no extension of the article's elastomeric yarns. When in use, however, extension of the elastomeric yarns causes opening 112 of storage compartment or pocket 110 to lay flush with inner skin-facing surface so as to provide reversible securement of object 125 therein.

Thus, the presently disclosed article 100 can be configured as an ankle band that can be worn and as it may appear when extended over the ankle area and a portion of the lower leg. Pocket 110 of article 100 can be positioned in proximity to an end of the tubular structure of any length, for example, near the upper or lower leg area so that the pocket and/or its contents can be readily accessed. Likewise, article 100 can be configured as a leg or knee band, to be worn extended over the knee area and a portion of lower and upper leg, for example with pocket 110 of article 100 positioned in proximity to an end of the tubular structure, for example, near the thigh area so that the pocket and/or its contents can be readily accessed.

Likewise, article 100, can be configured as an armband, to be worn and as it may appear when extended over an elbow and a portion of upper and lower arm, for example, with pocket 110 of article 100 positioned in proximity to either end of the tubular structure, for example, near the wrist or above the elbow area so that the pocket and/or its contents can be readily accessed.

As no single yarn technology can attract and repel moisture at the same time, in some embodiments, two different yarn technologies interwoven together to form inner and outer layers can be used. Such combinations of yarns can include hydrophobic (or superhydrophobic) sweat repelling yarns in combination with water absorbing yarns (hydrophilic) arranged substantially more distant from the sweat producing skin. Examples of hydrophobic yarns include polypropylene, polyethylene or blends thereof. Examples of hydrophilic yarns include cotton, cotton synthetic blends, wall, nylon, polyester or acrylics.

While not to held to any theory, such (super) hydrophobic yarns are technically not "wicking" yarns as they repel rather than transport water. At the molecular level, moisture doesn't adhere to the inner layer of certain hydrophobic yarn terry loop knits. Because sweat (moisture) does not adhere to the hydrophobic yarn, it can be analogized to mechanically lifting the sweat off the skin like a squeegee (as the article is under elastic stress during use, into a moisture attracting outer layer comprised of the hydrophilic yarn without retaining substantial amounts of moisture keeping the wearer's wrist for example, dry and comfortable in or in contact with all types of sports gear, in cold, hot and even wet conditions.

Thus, a welt layer can comprise a multilayer construction of course wise welts that includes a skin side layer, typically of hydrophobic yarns or elastic yarns and hydrophobic yarns and multilayer comprising hydrophilic yarns with one or more interwoven courses of hydrophobic yarns. The outer surface of welts can comprise additional interwoven coursewise layers to facilitate decorative printing and/or indicia functionality. Articles with such arrangement of multilayer construction of course wise welts can provide improved performance to the wearer in that sweat is removed from the skin and urged to the non-skin facing side.

Figure 8:
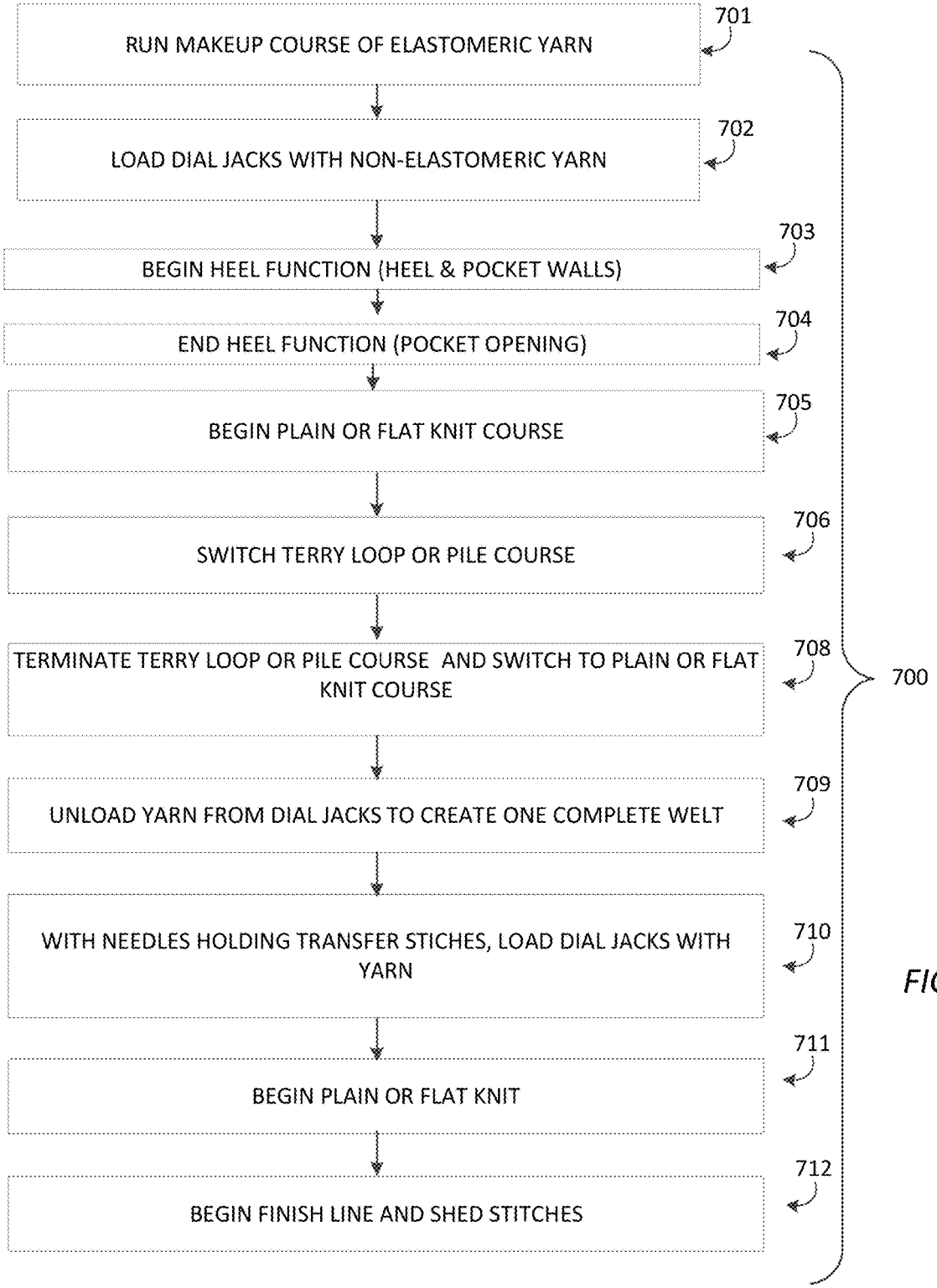
FIG. 8 is a process flowchart of an exemplary manufacturing method for providing a pocket band article disclosed and described herein.
Figure 9A:
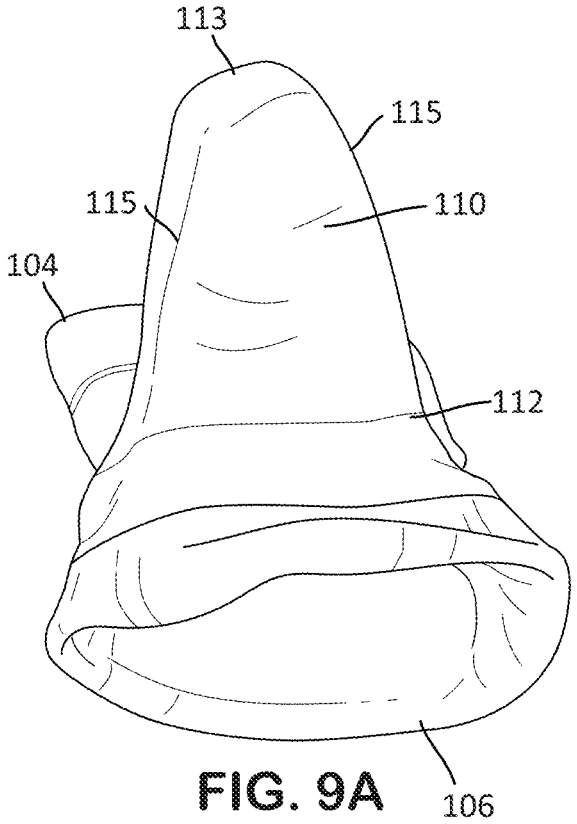
FIG. 9A is a digital image of the article in an inside-out configuration showing the storage compartment or pocket also in inside-out configuration extending from the article.

With reference to FIG. 8, an exemplary manufacturing process 700 of an embodiment of the present article is provided. Thus, as shown in Step 701 a makeup course is knitted, using a Terry Loop or Pile stitch of several courses. In some examples, the makeup comprises several courses of elastic yarn such as spandex. In other examples, the makeup comprises several courses of yarn excluding spandex. At the completion of the desired number of courses comprising the makeup, the dial jacks are loaded with, as in Step 703. In one example, the dial jacks are loaded in Step 703 with a hydrophilic yarn, such as nylon. At this point, the is created as in Step 703 where a heel function is run to create the heel 113 of the pocket 110 and its sides 115, the sides being gore lines. With reference to FIG. 9A, article 100 is presented in inside-out configuration with the pocket 110 also shown inside-out and extended from the article. In one example, substantially all of heel 113 and sides 115 are removed (not shown), the opening stitched closed avoid fraying or unwinding of the yarns, so as to provide total access to the entirety of the inner volume of the article 100.

Figure 9B:
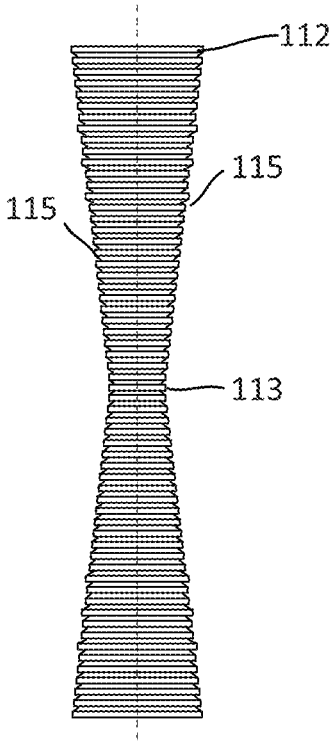
FIG. 9B is a representation of a computer program sequence associated with a circular knitting machine for creating a storage compartment or pocket.

As shown figuratively in FIG. 9B, the circular knitting needles are programmed to begin the opening 112 and to taper to the heel 113 along essentially parallel gore lines (sides 115) creating a storage compartment or pocket 110. The opening 112, heel 113, and pocket sides 115 are thus all integrally knitted with the article and not created in separate steps, which advantageously saves time and labor costs. After the heel function ends, the knitting returns to the Step 705 knitting structure.

With reference back to FIG. 8, in one example, in Step 704, courses of plain/knit yarn are knitted with the yarn of Step 703, with the yarns that loads the dial jacks removed. In some embodiments, Step 704 includes 3 to 4 courses. In one example, courses of plain/knit hydrophobic yarns are knitted with hydrophilic yarns (In Steps 703 and 704, respectively). A Terry loop/pile knit is then used, as in Step 706. In one example, the Terry loop/pile knit is then used, of Step 706 is hydrophilic yarn. In some embodiments, Step 706 is run for approximately 100-150 courses. The Terry loop/pile knit courses can optionally transition, (for example, from a hydrophilic yarn to hydrophobic yarn) as in Step 707 for approximately 50-70 courses, but this step can be eliminated. In Step 708, the Terry loop/pile knit courses are terminated and a plain or flat knit course is then used. In one example, the plain or flat knit of Step 708 is performed while using hydrophobic yarn. In some embodiments, Step 708 is run for 2-10 courses. In Step 709, yarns are unloaded from the dial jacks so as to create one complete welt. In Step 710, with needles holding transfer stitches from step 709, Step 702 is repeated. In Step 711, Step 705 is repeated, whereby a plane or flat knit course is run. In one example, in Step 710, the dial jacks are loaded with hydrophilic yarn and in Step 711, the dial jacks are loaded with hydrophobic yarns. At this point, the finish line is started, as in Step 712, so as to shed stitches without unraveling.

In one example, a Terry loop or pile course is begun using hydrophobic yarns after step 705 with the option of transition to hydrophobic yarn as in Step 707. In one example, the outside surface of the article is made thicker, whereas the terry loops/pile loops can be substantially hydrophilic yarns, which may improve the performance attributes of the article for certain applications while reducing cost and manufacture complexity. In one example, on completion of the desired plain knit courses, the make-up yarn is looped over dial jacks that run on either side of the terry needles so that after a length of fabric is knit, the dial jacks can transfer the make-up, essentially folding the fabric inward and back on itself. Welts can be processed further, and end sections can be seamed together as disclosed in co-assigned US Patent Application Publication No. 2016/0262470, the contents of which are incorporated herein by reference.

The article can be knit on a circular knitting machine of the type which permits selected courses to be plain knit and selected courses to be Terry loop or pile knit, to the completion of a continuous tubular article 100*b* of desired circumference and length. Circular knitting machines are well known in the art, such as a UNIPLET Model is ANGE 18.1 144 needle machine. Other circular knitting machines can be used, for example, a Lonati or San Jacomo, and the number of needles of the machine can be 108, 120, 168, 172, or 200, for example. The manufacture of the article, e.g., pocket band can employ manipulation of the yarns and/or needles, cams, and dial jacks during the knitting process as is known by one of skill in the art.

While the circular knitting machine can produce variable lengths of a continuous tubular article 100 with the storage compartment or pocket 110 made as a fixed length, and additional articles of variable length without storage compartment or pocket can be stitched together to provide other articles, such as hosiery, sweat pants, etc. Other methods of joining the opposing ends can be used.

Figure 10A:
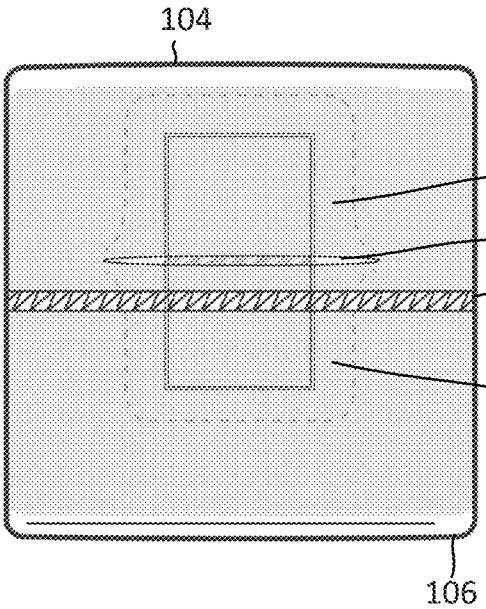
FIG. 10A shows an exemplary pocket band article having an alternative storage compartment configuration, according to an embodiment of the disclosure.
Figure 10B:
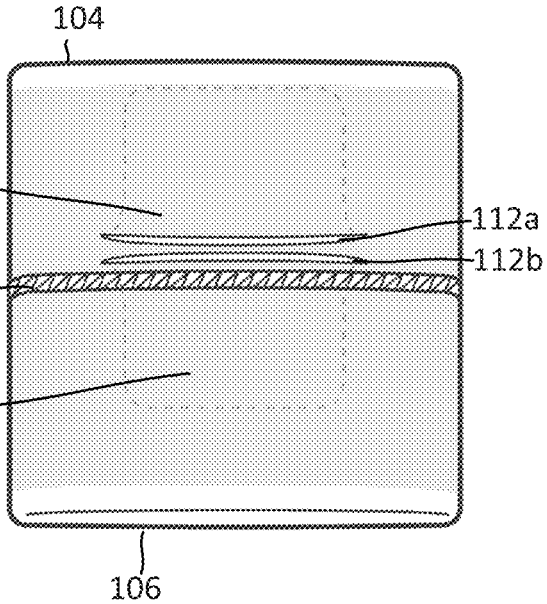
FIG. 10B shows an exemplary pocket band article having an alternative storage compartment configuration, according to an embodiment of the disclosure.

With reference to FIG. 10A, 10B, exemplary articles 200*a*, 200*b* are shown having similar construction to that of article 100, but differing in that one or more opening 112, 112*a*, 112*b* provides access to a plurality of storage compartment or pockets 110*a* and 110*b*. Article 200*a*, 200*b* provides for containment of larger articles and improved securement of such articles.

Contact Tracing/Proximity Using Presently Disclosed Article

According to another aspect of this disclosure, the pocket band article disclosed and described herein comprises a radio localization component for determining a proximity of a wearer of the article comprising a location device reversibly received by the storage compartment or pocket 110. In one example, the location device component is a Kinexon chip. (Kinexon, Munich DE). In another example, any GPS-based tracking device can be used.

In one example, the location device provides an audible indication of proximity to another person wearing the article comprising a similar location device such that individuals can be compliant with social distancing guidelines suggested by health care and governmental agencies. In another example, the proximity history of one or more players in a sporting event, where each player is wearing the article comprising the location device reversibly received by the storage compartment or pocket 110, can be obtained and analyzed so as to provide nonintrusive contact tracing of all individuals involved in the sporting event. The pocket band article comprising the location device is configured to receive the radio location system in a comfortable, non-intrusive, reliable and precise manner. This allows for determining detailed proximity histories and statistics of one or all players engaged in sports games and for non-invasive contact tracing of the players in the event that one or more players subsequently tests contracts a communicable disease or condition or tests positive (asymptomatic) or is otherwise infectious.

In one example, the radio localization system, which preferably operates in real-time, comprises a first transceiver which is configured for being attached to an object. In one example, the radio localization system is configured for being associated with a person. In another example, the radio localization system is configured for being associated with an athlete during a sport event. In other examples, the object is the sport band.

In the following description the term "first transceiver" denotes a component that is configured to received by the pocket band article, the first transceiver configured to emit and/or receive a radio signal, and is used interchangeably with "transmitter", "receiver" or "tag". The term "second transceivers" denotes one or more components defining a localization grid with reference positions and is used interchangeably with "transmitters", "receivers" or "radio anchors", dependent on context.

For example, a person wearing the pocket band article as disclosed herein and a transmitter, receiver or tag, like an ice hockey player, a soccer player, a visitor or patron of an establishment or any other person.

We claim:

1. An article of fabric comprising:

a continuous tubular welt comprising a first open end and a second open end;

an outer surface between the first open end and the second open end, the outer surface continuously separated from an inner surface so as to define a continuous interior volume; and at least one pocket integrally knitted into the continuous interior volume with the inner surface, the at least one pocket terminating at a heel within the continuous interior volume such that a portion of the continuous interior volume extends between the inner surface and the at least one pocket, the at least one pocket having an opening at least partially circumscribing the inner surface and providing access to an interior of the pocket.

2. The article of claim 1, wherein the opening is more proximal to the first open end than the second open end.

3. The article of claim 1, further comprising a metal-containing yarn.

4. The article of claim 1, wherein the fabric comprises hydrophobic yarns in proximity to the inner surface and an amount of hydrophilic yarns more distant from the inner surface.

5. The article of claim 1, further comprising a contact tracing system component.

6. An article of fabric comprising a generally tubular shape body having an inner skin facing surface with a generally symmetric inner circumference, an outer surface having a generally non-symmetric outer circumference, and an integrally knitted pocket located on the inner surface, the integrally knitted pocket terminating at a heel so as to define a continuous interior volume between the inner skin facing surface and the integrally knitted pocket, the integrally knitted pocket having an opening at least partially circumscribing the inner skin facing surface.

7. The article of claim 6, wherein the non-symmetric outer circumference extends along a longitudinal axis of the article.

8. The article of claim 6, further comprising a contact tracing system component.

* * * * *